US006912870B2

(12) United States Patent
Gnadinger

(10) Patent No.: US 6,912,870 B2
(45) Date of Patent: Jul. 5, 2005

(54) REFRIGERATOR AND ICE MAKER METHODS AND APPARATUS

(75) Inventor: Errin W. Gnadinger, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/609,960

(22) Filed: Jun. 30, 2003

(65) Prior Publication Data

US 2004/0261433 A1 Dec. 30, 2004

(51) Int. Cl.[7] ..... B67D 5/62
(52) U.S. Cl. ..... 62/389; 222/14; 222/146.6
(58) Field of Search ..... 222/14, 33, 146.6, 222/52, 129.1, 144.5; 62/389, 390

(56) References Cited

U.S. PATENT DOCUMENTS 3,765,569 A * 10/1973 Rimini ..... 222/641
4,191,025 A 3/1980 Webb
4,433,701 A * 2/1984 Cox et al. ..... 137/101.19
4,520,950 A 6/1985 Jeans
4,793,513 A * 12/1988 Verheijen ..... 222/14
4,885,943 A * 12/1989 Tootell et al. ..... 73/861.77
5,124,934 A * 6/1992 Kawamoto et al. ..... 700/282
5,419,150 A 5/1995 Kaiser et al.
5,542,450 A * 8/1996 King et al. ..... 137/614.2
5,551,598 A * 9/1996 Cutsinger ..... 222/52
5,819,547 A * 10/1998 Oh ..... 62/188
5,911,744 A 6/1999 Kawaguchi
6,354,342 B1 * 3/2002 Gagliano ..... 141/94
6,550,642 B2 * 4/2003 Newman et al. ..... 222/39

* cited by examiner

*Primary Examiner*—William E. Tapolcai
(74) *Attorney, Agent, or Firm*—H. Neil Houser, Esq.; Armstrong Teasdale LLP

(57) ABSTRACT

A refrigerator includes a fresh food compartment, a freezer compartment separated from the fresh food compartment by a mullion, a water dispenser coupled to at least one of the fresh food compartment and the freezer compartment, a user interface coupled to at least one of the fresh food compartment and the freezer compartment, and a controller operationally coupled to the water dispenser. The controller is configured to receive a signal representative of a user desired amount of water, and dispense an amount of water equal to the desired amount.

23 Claims, 3 Drawing Sheets

REFRIGERATOR AND ICE MAKER METHODS AND APPARATUS

BACKGROUND OF THE INVENTION

This invention relates generally to refrigerators, and more specifically, to water delivery operations of a refrigerator.

Water pressures in some communities and even within neighborhoods may vary from 10 pounds per square inch (psi) to 150 psi. Therefore water delivery operations (i.e., water fill to an ice maker and water delivery to a water dispenser) oftentimes use a self regulating flow washer which may create loud noise at pressures above about 45 psi. Additionally, for refrigerators including ice makers, the known fill operations may cause an under filling and/or an over filling of an ice mold.

BRIEF DESCRIPTION OF THE INVENTION

In one aspect, a refrigerator includes a fresh food compartment, a freezer compartment separated from the fresh food compartment by a mullion, a door movably positioned to cover the freezer compartment when in a closed position, and a water supply including at least one valve and a turbine ratemeter in flow communication with the valve. The refrigerator also includes at least one of an ice maker positioned within the freezer compartment coupled to the water supply, and a through the door water dispenser coupled to the water supply. The refrigerator also includes a controller operationally coupled to the valve and the turbine ratemeter. The controller is configured to open the valve to allow water flow therethrough, receive a plurality of pulses from the ratemeter, wherein each pulse is representative of a quantity of water flow therethrough, and close the valve upon receipt of a predetermined number of pulses.

In another aspect, an ice maker includes a mold including at least one cavity for containing water therein for freezing into ice, a water supply including at least one valve for controlling water flow into the mold, a turbine ratemeter in flow communication with the valve, and a controller operationally coupled to the valve and the ratemeter. The controller is configured to open the valve to allow water flow therethrough, receive a plurality of pulses from the ratemeter, wherein each pulse is representative of a quantity of water flow therethrough, and close the valve upon receipt of a predetermined number of pulses.

In yet another aspect, a refrigerator includes a fresh food compartment, a freezer compartment separated from the fresh food compartment by a mullion, and an ice maker positioned within the freezer compartment. The ice maker includes a mold including at least one cavity for containing water therein for freezing into ice, a water supply comprising at least one valve for controlling water flow into the mold, and a turbine ratemeter in flow communication with the valve. The refrigerator also includes a controller operationally coupled to the valve and the ratemeter, and configured to open the valve to allow water flow therethrough, receive a plurality of pulses from the ratemeter, wherein each pulse is representative of a quantity of water flow therethrough, and close the valve upon receipt of a predetermined number of pulses.

In another aspect, a refrigerator includes a fresh food compartment, a freezer compartment separated from the fresh food compartment by a mullion, a door movably positioned to cover the freezer compartment when in a closed position, and a water supply including at least one valve and a turbine ratemeter in flow communication with the valve. The refrigerator also includes a through the door water dispenser coupled to the water supply, and a controller operationally coupled to the valve and the turbine ratemeter. The controller is configured to open the valve to allow water flow therethrough, receive a plurality of pulses from the ratemeter, wherein each pulse is representative of a quantity of water flow therethrough, and close the valve upon receipt of a predetermined number of pulses.

In still another aspect, a refrigerator includes a fresh food compartment, a freezer compartment separated from the fresh food compartment by a mullion, a water dispenser coupled to at least one of the fresh food compartment and the freezer compartment, a user interface coupled to at least one of the fresh food compartment and the freezer compartment, and a controller operationally coupled to the water dispenser. The controller is configured to receive a signal representative of a user desired amount of water, and dispense an amount of water equal to the desired amount.

DETAILED DESCRIPTION OF THE INVENTION

Figure 1:
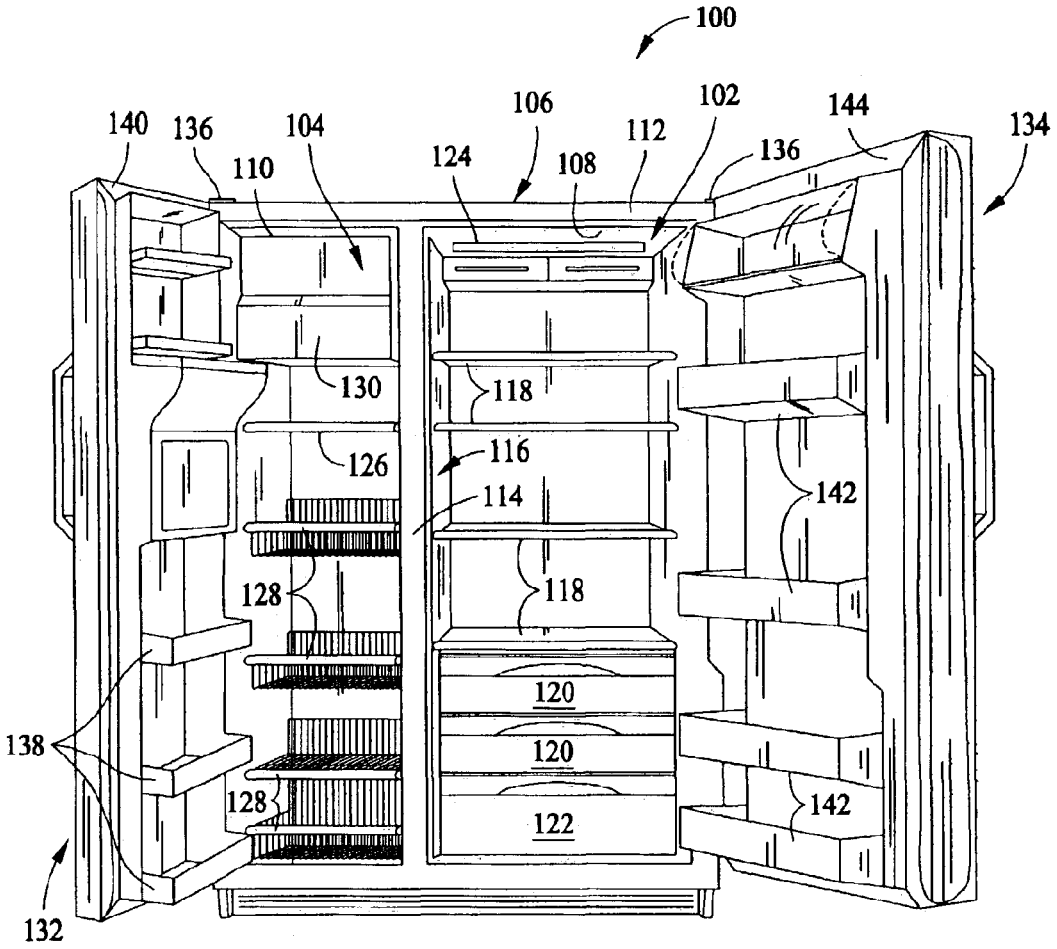
FIG. 1 illustrates a side-by-side refrigerator.

FIG. 1 illustrates an exemplary refrigerator 100. While the apparatus is described herein in the context of a specific refrigerator 100, it is contemplated that the herein described methods and apparatus may be practiced in other types of refrigerators. Therefore, as the benefits of the herein described methods and apparatus accrue generally to ice maker controls in a variety of refrigeration appliances and machines, the description herein is for exemplary purposes only and is not intended to limit practice of the invention to a particular refrigeration appliance or machine, such as refrigerator 100.

Refrigerator 100 includes a fresh food storage compartment 102 and freezer storage compartment 104. Freezer compartment 104 and fresh food compartment 102 are arranged side-by-side, however, the benefits of the herein described methods and apparatus accrue to other configurations such as, for example, top and bottom mount refrigerator-freezers. Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also, in one embodiment, is formed of an extruded ABS material. Breaker strip, 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 is positioned within compartment 102. A shelf 126 and wire baskets 128 are also provided in freezer compartment 104. In addition, an ice maker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Figure 2:
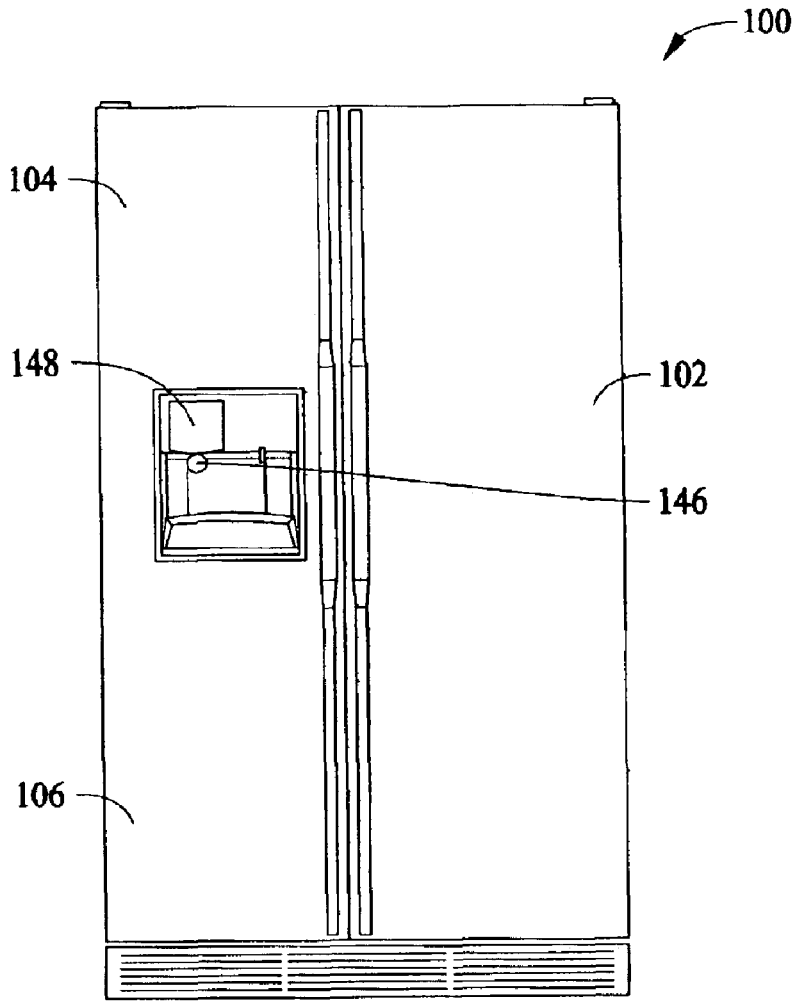
FIG. 2 is front view of the refrigerator of FIG. 1.

FIG. 2 is a front view of refrigerator 100 with doors 102 and 104 in a closed position. Freezer door 104 includes a through the door water dispenser 146, and a user interface 148.

In use, and as explained in greater detail below, a user enters a desired amount of water using interface 148, and the desired amount is dispensed by dispenser 146. For example, a recipe calls for certain amount of water (e.g., ⅓ cup, ½ cup, 1 tablespoon, 2 teaspoons, 6 ounces, etc.), and instead of using a measuring cup, the user can use any size container (large enough to hold the desired amount) by entering the desired amount using interface 148, and receiving the desired amount via dispenser 146.

Figure 3:
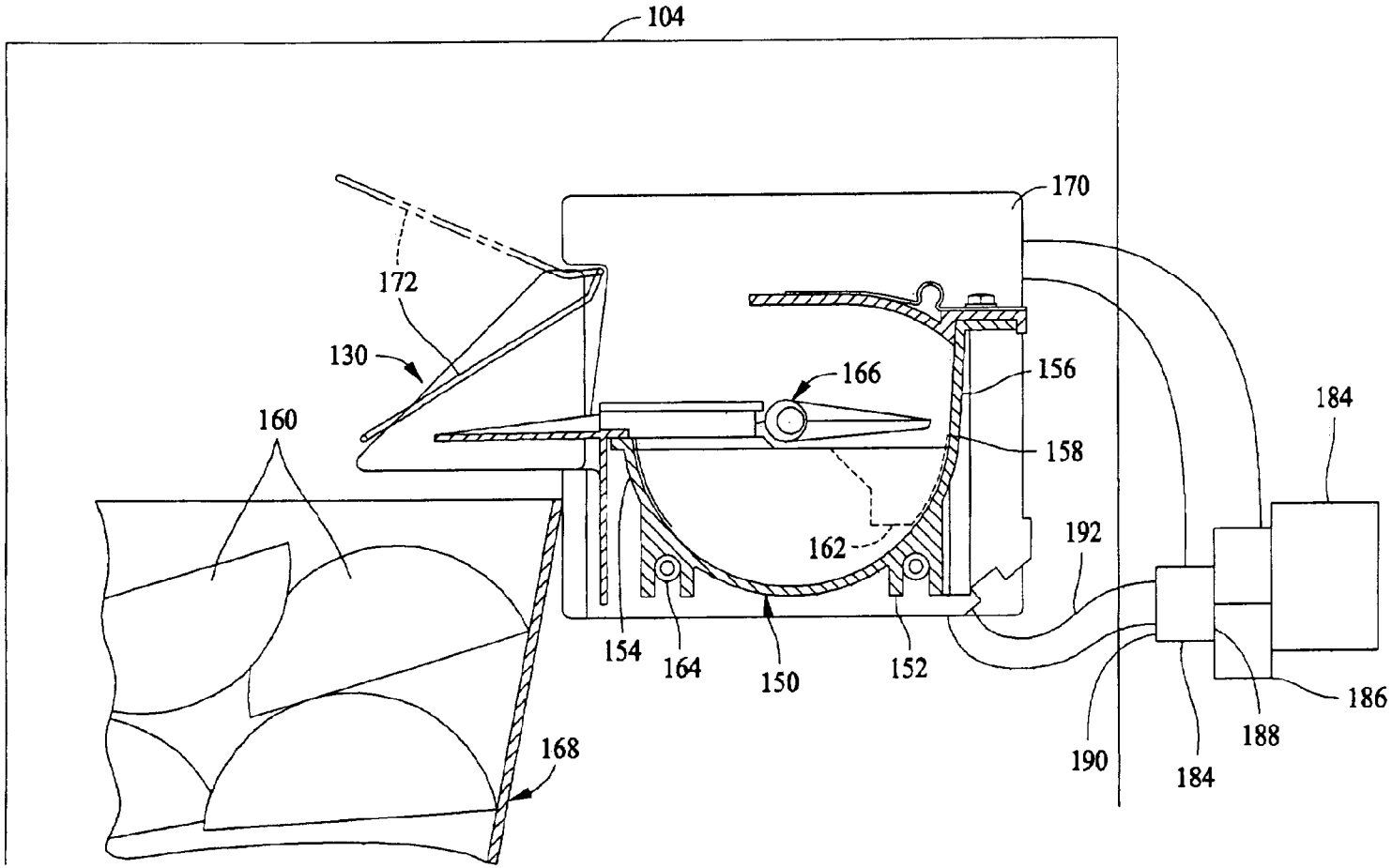
FIG. 3 is a cross sectional view of an exemplary ice maker in a freezer compartment.

FIG. 3 is a cross sectional view of ice maker 130 including a metal mold 150 with a tray structure having a bottom wall 152, a front wall 154, and a back wall 156. A plurality of partition walls 158 extend transversely across mold 150 to define cavities in which ice pieces 160 are formed. Each partition wall 158 includes a recessed upper edge portion 162 through which water flows successively through each cavity to fill mold 150 with water.

A sheathed electrical resistance ice removal heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve 182 connected to a water source 184 and delivering water to mold 150 through an inlet structure (not shown). A turbine ratemeter 186 is positioned in flow communication with valve 184. In one embodiment, ratemeter 186 is positioned proximate an inlet side 188 of valve 184 as shown in FIG. 3. In another embodiment, ratemeter 186 is positioned proximate a discharge side 190 of valve 184.

In order to sense a level of ice pieces 160 in storage bin, 168 controller actuates a spring loaded feeler arm 172 for controlling an automatic ice harvest so as to maintain a selected level of ice in storage bin 168. Feeler arm 172 is automatically raised and lowered during operation of ice maker 130 as ice is formed. Feeler arm 172 is spring biased to a lowered "home" position that is used to determine initiation of a harvest cycle and raised by a mechanism (not shown) as ice is harvested to clear ice entry into storage bin 138 and to prevent accumulation of ice above feeler arm 172 so that feeler arm 172 does not move ice out of storage bin 168 as feeler arm 172 raises. When ice obstructs feeler arm 172 from reaching its home position, controller 170 discontinues harvesting because storage bin 168 is sufficiently full. As ice is removed from storage bin 168, feeler arm 172 gradually moves to its home position, thereby indicating a need for more ice and causing controller 170 to initiate a fill operation as described in more detail below.

In another exemplary embodiment, a cam-driven feeler arm (not shown) rotates underneath ice maker 130 and out over storage bin 168 as ice is formed. Feeler arm 172 is spring biased to an outward or "home" position that is used to initiate an ice harvest cycle, and is rotated inward and underneath ice maker 130 by a cam slide mechanism (not shown) as ice is harvested from ice maker mold 150 so that the feeler arm does not obstruct ice from entering storage bin 168, and to prevent accumulation of ice above the feeler arm. After ice is harvested, the feeler arm is rotated outward from underneath ice maker 130, and when ice obstructs the feeler arm and prevents the feeler arm from reaching the home position, controller 170 discontinues harvesting because storage bin 168 is sufficiently full. As ice is removed from storage bin 168, feeler arm 172 gradually moves to its home position, thereby indicating a need for more ice and causing controller 170 to initiate to initiate a fill operation as described in more detail below.

In use, turbine ratemeter 186 generates a square wave signal that is supplied to controller 170. More specifically, during a fill operation, controller 170 opens valve 182, and receives a plurality of square waves (i.e., pulses) from ratemeter 186 representative of a quantity of water flow therethrough. When the number of received pulses reaches a predetermined number, controller 170 closes valve 182 to stop water flow through ratemeter 186 and valve 182. Because each pulse represents a specific quantity of water that flowed though ratemeter 186, each fill operation delivers the same amount of water regardless of water pressure. Additionally, in one embodiment, a user interface 192 is operationally coupled to controller 170, and the user is able to indicate a fill amount to increase or decrease the size of the ice cubes being made. The predetermined number of received pulses at which controller 170 closes valve 182 is selected based upon the user selected fill level.

In one embodiment, a capillary tube 192 is positioned between valve 182 and the ice maker inlet. Capillary tube 192 has an inner diameter (ID) between about 0.075 inches and about 0.175 inches, and a length between about 12 inches and about 60 inches. Capillary tube 192 slows the flow rate of water through valve 182 resulting in quieter fill operations than in embodiments without capillary tube 192 (e.g., with a tube the same size as supply tube 184). In an empirical study, the noise from fill operations was reduced from 45 decibels (Accoustic) dBA without capillary tube 192 (i.e., using a known self regulating flow washer) to 24 dBA with capillary tube 192. Because each pulse represents a specific quantity of water that flowed though ratemeter 186, each fill operation delivers the same amount of water regardless of tube size. Accordingly, ratemeter 186 and capillary tube 192 provide for low noise accurate fill operations.

In an exemplary embodiment, water supply 184, ratemeter 186, and valve 182 are utilized in conjunction with dispenser 146 which is in flow communication with valve 182. A user enters a desired amount of water using interface 148, and receives the desired amount via dispenser 146. More particularly, controller 170 opens valve 182 to allow water flow therethrough and through dispenser 146 in flow communication with valve 182. Controller 170 receives a plurality of pulses from ratemeter 186, wherein each pulse is representative of a quantity of water flow therethrough. Controller 170 then closes valve 182 upon receipt of a predetermined number of pulses. The predetermined number is based on the entered desired amount. For example, when the user enters ½ cup, valve 182 is closed after 400 pulses, and when the user enters 1 cup, valve 182 is closed after 800 pulses. Of course this example is for a ratemeter generating 800 pulses per cup (i.e., each pulse represents 1/800 cup). For ratemeters in which a pulse represents an amount different than 1/800 cup, the predetermined number of pulsed will be different.

While described in the context of a single controller controlling a fill operation for an ice maker and a dispense operation for a water dispenser, it is contemplated that different controllers may be used. Also, as used herein, the term controller is not limited to just those integrated circuits referred to in the art as controllers, but broadly refers to computers, processors, microcontrollers, microcomputers, programmable logic controllers, application specific integrated circuits, and other programmable circuits, such as, for example, field programmable gate arrays, and these terms are used interchangeably herein. Additionally, although described in the context of a single valve and a single ratemeter for both ice maker fill operations and water dispensing operations, other embodiments employ a separate valve and/or ratemeter for each operation.

As used herein, an element or step recited in the singular and preceded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

While the invention has been described in terms of various specific embodiments, those skilled in the art will recognize that the invention can be practiced with modification within the spirit and scope of the claims.

What is claimed is:

1. A refrigerator comprising:

a fresh food compartment;

a freezer compartment separated from said fresh food compartment by a mullion;

a door movably positioned to cover said freezer compartment when in a closed position;

a water supply comprising at least one valve and a turbine ratemeter in flow communication with said valve;

at least one of:

an ice maker positioned within said freezer compartment coupled to said water supply; and a through the door water dispenser coupled to said water supply; and a controller operationally coupled to said valve and said turbine ratemeter, said controller configured to:

open said valve to allow water flow therethrough;

receive a plurality of pulses from said ratemeter, each pulse representative of a quantity of water flow therethrough; and close said valve upon receipt of a predetermined number of pulses.

2. A refrigerator in accordance with claim 1 wherein said controller further configured to receive a signal representative of a user selected fill level, wherein the predetermined number of pulses is based on the user selected fill level.

3. A refrigerator in accordance with claim 1 wherein said controller further configured to receive a signal representative of a user selected ice mold fill level, wherein the predetermined number of pulses is based on the user selected fill level.

4. A refrigerator in accordance with claim 1 wherein said controller further configured to receive a signal representative of a user selected container fill level, wherein the predetermined number of pulses is based on the user selected fill level.

5. An ice maker comprising:

a mold comprising at least one cavity for containing water therein for freezing into ice;

a water supply comprising at least one valve for controlling water flow into said mold;

a turbine ratemeter in flow communication with said valve; and a controller operationally coupled to said valve and said ratemeter and configured to:

open said valve to allow water flow therethrough;

receive a plurality of pulses from said ratemeter, each pulse representative of a quantity of water flow therethrough; and close said valve upon receipt of a predetermined number of pulses.

6. An ice maker in accordance with claim 5 wherein said turbine ratemeter positioned proximate an inlet side of said valve.

7. An ice maker in accordance with claim 5 wherein said turbine ratemeter positioned proximate a discharge side of said valve.

8. An ice maker in accordance with claim 5 wherein said controller further configured to receive a signal representative of a user selected fill level, wherein the predetermined number of pulses is based on the user selected fill level.

9. An ice maker in accordance with claim 5 wherein said water supply further comprises a capillary tube positioned between said valve and said mold.

10. An ice maker in accordance with claim 9 wherein said capillary tube comprises an inner diameter (ID) between about 0.075 inches and about 0.175 inches.

11. An ice maker in accordance with claim 9 wherein said capillary tube comprises a length between about 12 inches and about 60 inches.

12. An ice maker in accordance with claim 10 wherein said capillary tube comprises a length between about 12 inches and about 60 inches.

13. A refrigerator comprising:

a fresh food compartment;

a freezer compartment separated from said fresh food compartment by a mullion;

an ice maker positioned within said freezer compartment, said ice maker comprising:

a mold comprising at least one cavity for containing water therein for freezing into ice;

a water supply comprising at least one valve for controlling water flow into said mold; and a turbine ratemeter in flow communication with said valve; and a controller operationally coupled to said valve and said ratemeter, and configured to:

open said valve to allow water flow therethrough;

receive a plurality of pulses from said ratemeter, wherein each pulse representative of a quantity of water flow therethrough; and close said valve upon receipt of a predetermined number of pulses.

14. A refrigerator in accordance with claim 13 wherein said turbine ratemeter positioned proximate an inlet side of said valve.

15. A refrigerator in accordance with claim 13 wherein said turbine ratemeter positioned proximate a discharge side of said valve.

16. A refrigerator in accordance with claim 13 wherein said controller further configured to receive a signal representative of a user selected fill level, wherein the predetermined number of pulses is based on the user selected fill level.

17. A refrigerator comprising:

a fresh food compartment;

a freezer compartment separated from said fresh food compartment by a mullion;

a door movably positioned to cover said freezer compartment when in a closed position;

a water supply comprising at least one valve and a turbine ratemeter in flow communication with said valve;

a through the door water dispenser coupled to said water supply; and a controller operationally coupled to said valve and said turbine ratemeter, said controller configured to:

open said valve to allow water flow therethrough;

receive a plurality of pulses from said ratemeter, wherein each pulse representative of a quantity of water flow therethrough; and close said valve upon receipt of a predetermined number of pulses.

18. A refrigerator in accordance with claim 17 wherein said controller further configured to receive a signal representative of a user selected container fill level, wherein the predetermined number of pulses is based on the user selected fill level.

19. A refrigerator in accordance with claim 18 wherein said turbine ratemeter positioned proximate an inlet side of said valve.

20. A refrigerator in accordance with claim 17 wherein said turbine ratemeter positioned proximate a discharge side of said valve.

21. A refrigerator comprising:

a fresh food compartment;

a freezer compartment separated from said fresh food compartment by a mullion;

a water dispenser coupled to at least one of said fresh food compartment and said freezer compartment;

a user interface coupled to at least one of said fresh food compartment and said freezer compartment, said user interface configured to receive a numerical quantity relating to a desired amount of water;

a turbine ratemeter configured to determine a quantity of water flow therethrough; and a controller operationally coupled to said water dispenser and said turbine ratemeter, said controller configured to:

receive a signal representative of a user entered numerical quantity relating to the desired amount of water; and dispense an amount of water equal to the entered amount.

22. A refrigerator in accordance with claim 21 further comprising a freezer door movably positioned to cover said freezer compartment when in a closed position, said water dispenser and said user interface coupled to said freezer compartment via said door, said water dispenser comprising a through the door water dispenser.

23. A refrigerator in accordance with claim 21 further comprising a water supply comprising a valve and said turbine ratemeter in flow communication with said valve, said controller operationally coupled to said valve and said turbine ratemeter, said controller configured to dispense an amount of water equal to the entered amount by:

opening said valve to allow water flow therethrough;

receiving a plurality of pulses from said ratemeter, wherein each pulse representative of a quantity of water flow therethrough; and closing said valve upon receipt of a predetermined number of pulses.

* * * * *

US006912870C1

(12) EX PARTE REEXAMINATION CERTIFICATE (5942nd)

United States Patent

Gnadinger

(10) Number: US 6,912,870 C1

(45) Certificate Issued: Oct. 9, 2007

(54) REFRIGERATOR AND ICE MAKER METHODS AND APPARATUS

(75) Inventor: Errin W. Gnadinger, Louisville, KY (US)

(73) Assignee: General Electric Company, Schenectady, NY (US)

Reexamination Request:
No. 90/007,715, Sep. 12, 2005

Reexamination Certificate for:

| | |
|---|---|
| Patent No.: | **6,912,870** |
| Issued: | **Jul. 5, 2005** |
| Appl. No.: | **10/609,960** |
| Filed: | **Jun. 30, 2003** |

(51) Int. Cl.
*B67D 5/62* (2006.01)

(52) U.S. Cl. ..... 62/389; 222/14; 222/146.6

(58) Field of Classification Search ..... None
See application file for complete search history.

(56) References Cited

U.S. PATENT DOCUMENTS

| | | | | |
|---|---|---|---|---|
| 4,205,534 | A | * | 6/1980 | Goushaw ..... 62/177 |
| 5,022,557 | A | | 6/1991 | Turner |
| 5,291,004 | A | | 3/1994 | Frank et al. |
| 5,731,981 | A | | 3/1998 | Simard |
| 5,876,610 | A | | 3/1999 | Clack et al. |
| 6,051,144 | A | | 4/2000 | Clack et al. |
| 6,093,312 | A | | 7/2000 | Boulter |
| 6,097,993 | A | | 8/2000 | Skupin et al. |
| 6,164,189 | A | | 12/2000 | Anson |
| 6,355,177 | B2 | | 3/2002 | Senner et al. |

* cited by examiner

*Primary Examiner*—Sara Clarke

(57) ABSTRACT

A refrigerator includes a fresh food compartment, a freezer compartment separated from the fresh food compartment by a mullion, a water dispenser coupled to at least one of the fresh food compartment and the freezer compartment, a user interface coupled to at least one of the fresh food compartment and the freezer compartment, and a controller operationally coupled to the water dispenser. The controller is configured to receive a signal representative of a user desired amount of water, and dispense an amount of water equal to the desired amount.

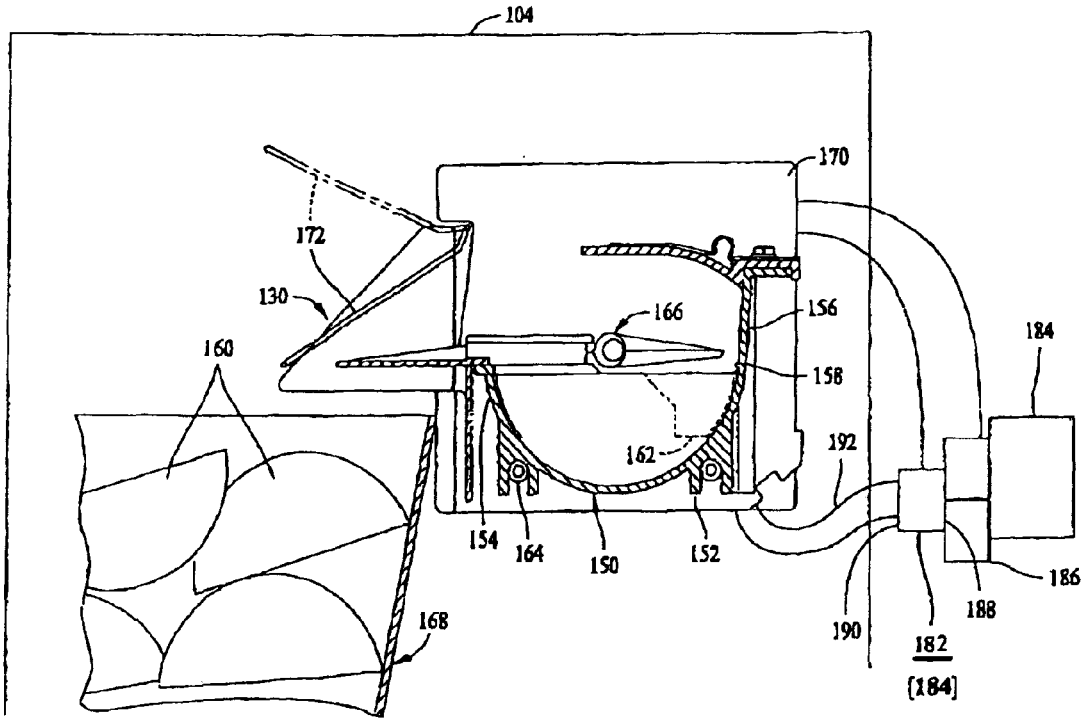

AMENDED

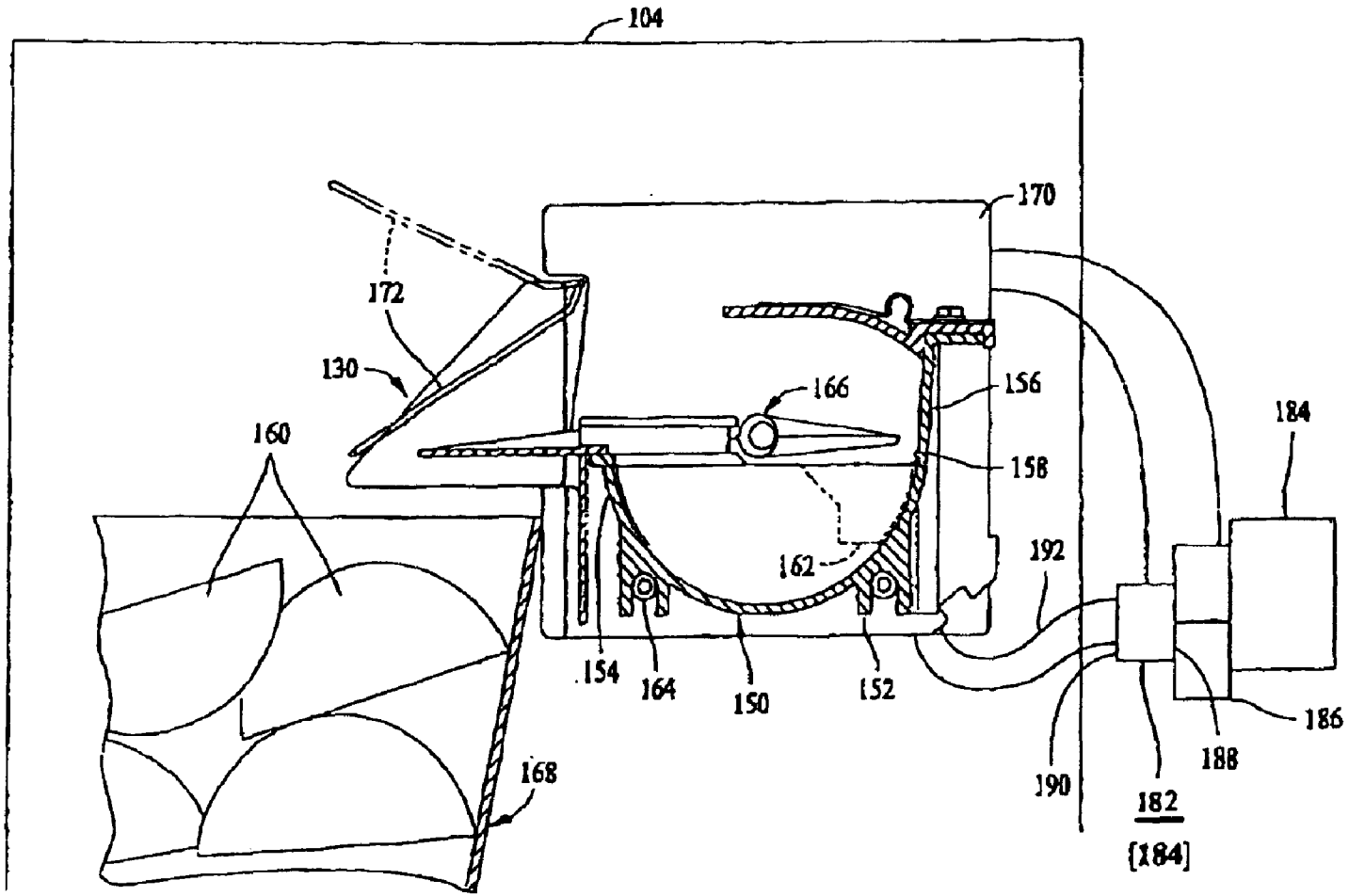
FIG. 3
AMENDED

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 3, line 53 to column 4, line 4:

A sheathed electrical resistance ice removal heating element 164 is press-fit, staked, and/or clamped into bottom wall 152 of mold 150 and heats mold 150 when a harvest cycle is executed to slightly melt ice pieces 160 and release them from the mold cavities. A rotating rake 166 sweeps through mold 150 as ice is harvested and ejects ice from mold 150 into a storage bin 168 or ice bucket. Cyclical operation of heater 164 and rake 166 are effected by a controller 170 disposed on a forward end of mold 150, and controller 170 also automatically provides for refilling mold 150 with water for ice formation after ice is harvested through actuation of a water valve 182 connected to a water source 184 and delivering water to mold 150 through an inlet structure (not shown). A turbine ratemeter 186 is positioned in flow communication with valve [184] *182*. In one embodiment, ratemeter 186 is positioned proximate an inlet side 188 of valve [184] *182* as shown in FIG. 3. In another embodiment, ratemeter 186 is positioned proximate a discharge side 190 of valve [184] *182*.

THE DRAWING FIGURES HAVE BEEN CHANGED AS FOLLOWS:

Originally there were two reference characters "184" in FIG. 3. The lower one has been changed to "182".

AS A RESULT OF REEXAMINATION, IT HAS BEEN DETERMINED THAT:

The patentability of claims 1–23 is confirmed.

* * * * *